US006249262B1

(12) United States Patent
Lee et al.

(10) Patent No.: US 6,249,262 B1
(45) Date of Patent: Jun. 19, 2001

(54) SWITCHABLE ANTENNA FOR RADIO COMMUNICATION DEVICES

(75) Inventors: Chye Lin Lee, Relau; Peng How Khoo, Tanjong Bungah; Giap Hong Lim; Boon Eu Seow, both of Relau, all of (MY)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/433,292

(22) Filed: Nov. 3, 1999

(51) Int. Cl.[7] ..... H01Q 1/36

(52) U.S. Cl. ..... 343/895; 343/702; 343/876; 343/906

(58) Field of Search ..... 343/702, 895, 343/876, 906; H01Q 1/36

(56) References Cited

U.S. PATENT DOCUMENTS 4,772,895 9/1988 Garay et al. ..... 343/895
6,005,523 * 12/1999 Rudisill ..... 343/702
6,069,592 * 5/2000 Wass ..... 343/702

* cited by examiner

*Primary Examiner*—Don Wong
*Assistant Examiner*—Hoang Nguyen
(74) *Attorney, Agent, or Firm*—Dale W. Dorinski

(57) ABSTRACT

A switchable antenna (10) with a base antenna assembly (11), a secondary antenna assembly (12) and a switch. Base and secondary antenna assemblies (11,12) have respective housings (21,23) to respectively house helical antennas (31,40). Secondary antenna assembly (12) is mounted to and operably coupled to base antenna assembly (11) with a connector (13). A contact member (18) of base antenna assembly (11) has a contact ball bearing (20) and a conductive plate (22). Secondary antenna assembly (12) has a contact member (19) with a conductive plate (25) and a dimple (26). The switch is formed by connector (13), ball bearing (20) and conductive plates (22,25) and selectively electrically couples adjacent ends (32,41) of helical antennas (31,40) by relative rotation about a common longitudinal axis (43).

8 Claims, 4 Drawing Sheets

SWITCHABLE ANTENNA FOR RADIO COMMUNICATION DEVICES

FIELD OF THE INVENTION

This invention relates to antennas for radio communication devices. in particular, this invention relates to, but is not necessarily limited to, a switchable antenna for a radio communication device.

BACKGROUND OF THE INVENTION

Antennas for radio communication devices, such as two-way radios, are known in the art to transceive electromagnetic waves that propagate through space. The type of electromagnetic waves transceived by these two-way radios is radiofrequency (RF) waves that serve as carriers of information. When encoded with information, such carriers are commonly referred to as RF signals.

Conventionally, circuitry of a two-way radio is designed to process RF signals transceived on one or more frequencies within a band of the RF spectrum. For example, the very high frequency (VHF) band for radio communications ranges from 30 MHz to 300 MHz. Accordingly, two-way radios in a VHF radio communication system transceive RF signals using the one or more frequencies within the VHF band.

As is known in the art, the circuitry described in the above needs to couple to an antenna to transceive RF signals. The length of such an antenna depends on wavelength of the RF signals and this wavelength is related to the frequency of the RF signals. Generally, a lower frequency RF signal requires an antenna that is longer than an antenna for a higher frequency RF signal. Hence, there is a problem when a two-way radio has to transceive RF signals varying within a bandwidth that is too wide for an antenna with a fixed length. U.S. Pat. No. 4,772,895 describes an antenna having two helical elements operably coupled to increase the antenna's bandwidth and thereby alleviate this problem. However, such an antenna also has a fixed length that cannot be easily modified to transceive RF signals not within its bandwidth. Therefore, there is a need for an antenna that can transceive RF signals varying within a bandwidth and also be easily modified for RF signals not within this bandwidth.

SUMMARY OF THE INVENTION

According to one aspect of the invention, there is provided a switchable antenna for a radio communication device comprising:

- a base antenna assembly comprising a housing with a base antenna;
- a secondary antenna assembly comprising a housing with a secondary antenna, said secondary antenna assembly being mounted to said base antenna assembly; and
- a switch for selectively electrically coupling adjacent ends of said base antenna and said secondary antenna.

BRIEF DESCRIPTION OF THE DRAWINGS

In order to describe the invention and to put it into practical effect, reference will now be made to a preferred embodiment of the invention as illustrated with reference to the accompanying drawings in which.

DETAILED DESCRIPTION OF THE INVENTION

Figure 1:
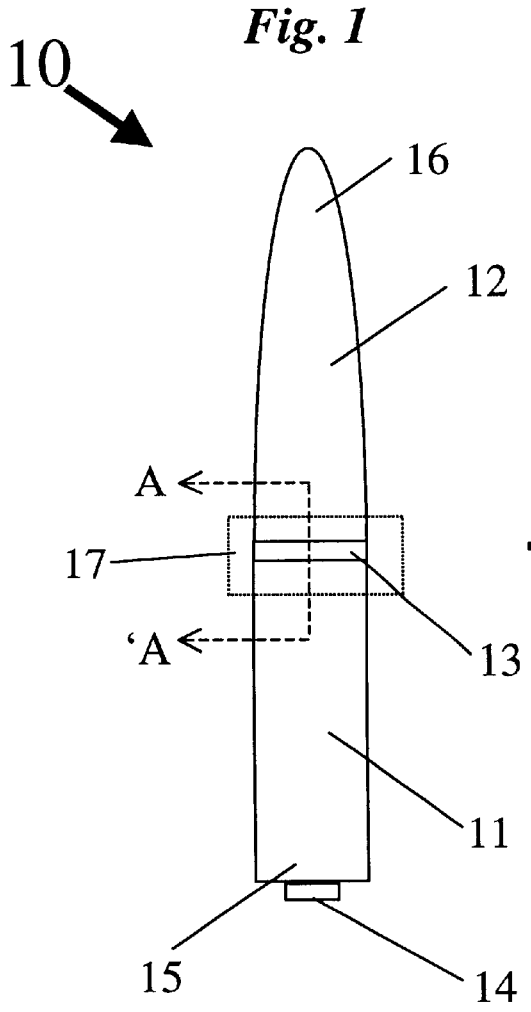
FIG. 1 is a side view of a switchable antenna in accordance with a preferred embodiment of the invention.

Referring to FIG. 1 there is shown a side view of a switchable antenna 10 comprising a base antenna assembly 11, a secondary antenna assembly 12 removably mounted with a connector 13 to base antenna assembly 11. Base antenna assembly 11 comprises a mounting member 14 at a base end 15. Mounting member 14 mounts base antenna assembly 11 to an antenna socket (not shown) of a radio communication device (not shown) such as, for example, a two-way radio to transceive RF signals. Secondary antenna assembly 12 has a free end 16 distal from base end 15. A portion 17 of antenna 10 is indicated and will be used to describe how base antenna assembly 11 is mounted to electrically couple to secondary antenna assembly 12.

Figure 2:
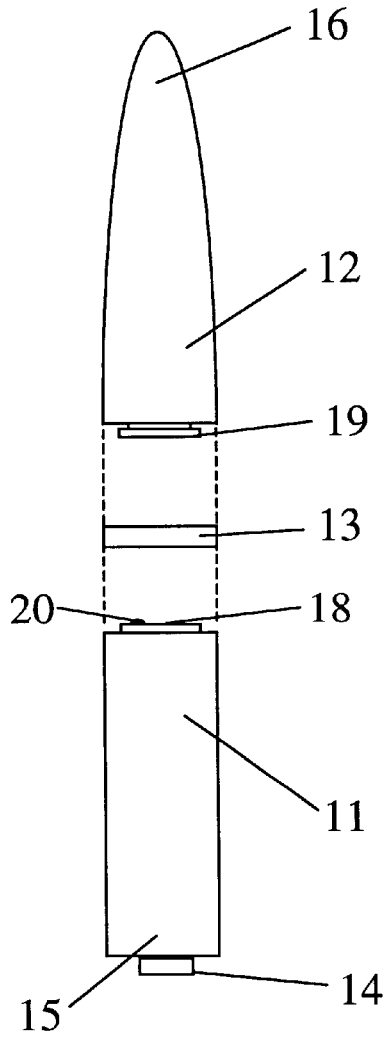
FIG. 2 is an exploded side view of the switchable antenna of FIG. 1.

Antenna 10 further comprises a switch that is shown in an exploded side view of antenna 10 in FIG. 2. The switch comprises connector 13, two contact members 18,19 and a contact ball bearing 20. Contact member 18 and ball bearing 20 is disposed at the top of base antenna assembly 11. Ball bearing 20 partially protrudes above a surface of contact member 18 and is retained by contact member 18 as it has a diameter that is larger than an opening (not shown in FIG. 2) for it on contact member 18. The purpose and operation of this switch is described below.

Figure 3:
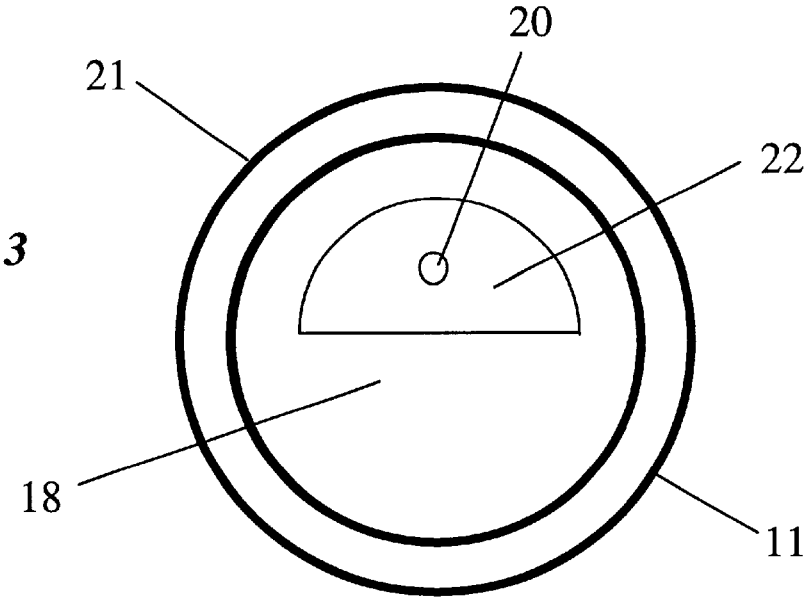
FIG. 3 is a top view of a base antenna assembly of the switchable antenna of FIG. 1.

Referring now to FIG. 3 which is a top view of base antenna assembly 11 showing disposition of contact member 18 and ball bearing 20 relative to the circumference of a housing 21 for base antenna assembly 11. Contact member 18 is circular and made from a non-electrically conductive material such as a hard plastics. Ball bearing 20 is electrically conductive and disposed on a semi-circular electrically conductive plate 22.

Figure 4:
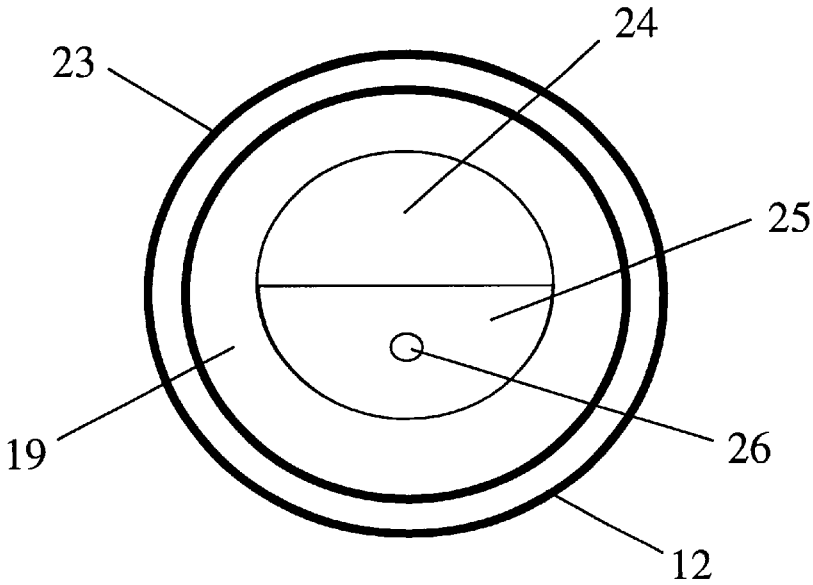
FIG. 4 is a bottom view of a secondary antenna assembly of the switchable antenna of FIG. 1.

A bottom view of secondary antenna assembly 12 is shown in FIG. 4. Disposition of contact member 19 is shown relative to the circumference of a housing 23 for secondary antenna assembly 12. Near the centre of contact member 19 is a semi-circular non-electrically conductive portion 24 and a semi-circular electrically conductive plate 25. Like contact member 18, portion 24 is made of a hard plastics. Conductive plate 25 has a dimple 26 to complementarily engage bearing 20.

Figure 5:
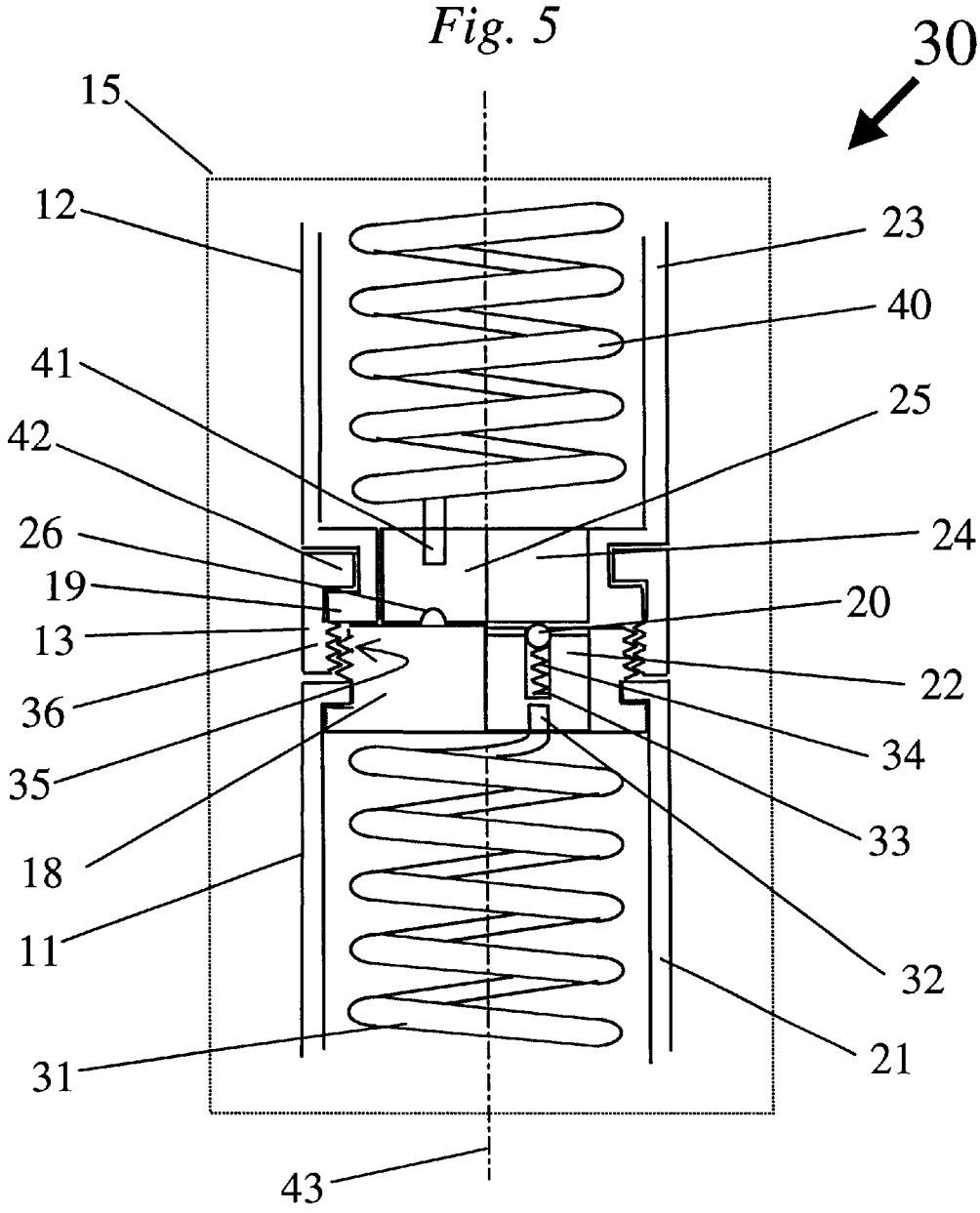
FIG. 5 is a longitudinal cross-section through line A–'A of the switchable antenna of FIG. 1 illustrating a first mode of operation.

Shown in FIG. 5 is a longitudinal cross-section of portion 17 through line A–'A of antenna 10 illustrating a first mode of operation 30. In this first mode of operation 30, secondary antenna assembly 12 is mounted to base antenna assembly 11 with connector 13. Enclosed in housing 21 is a base helical antenna 31 having an end 32 connected to conductive plate 22. Conductive plate 22 has a well 33 in which a compressed spring 34 is disposed. Spring 34 attaches to and biases ball bearing 20 towards secondary antenna assembly 12. As seen in this longitudinal cross-section, contact member 18 has a threaded circumference 35 to engage internal screw threads 36 at one end of connector 13.

Further shown in FIG. 5 is a secondary helical antenna 40 within secondary antenna assembly 12. Secondary helical antenna 40 has an end 41 connected to conductive plate 25. An inwardly extending lip 42, disposed at an opposite end of connector 13, engages contact member 19. With secondary antenna assembly 12 thus mounted to base antenna assembly 12 along a common longitudinal axis 43, antenna 10 is enabled to transceive RF signals using only base helical antenna 31 in the first mode of operation 30.

Figure 6:
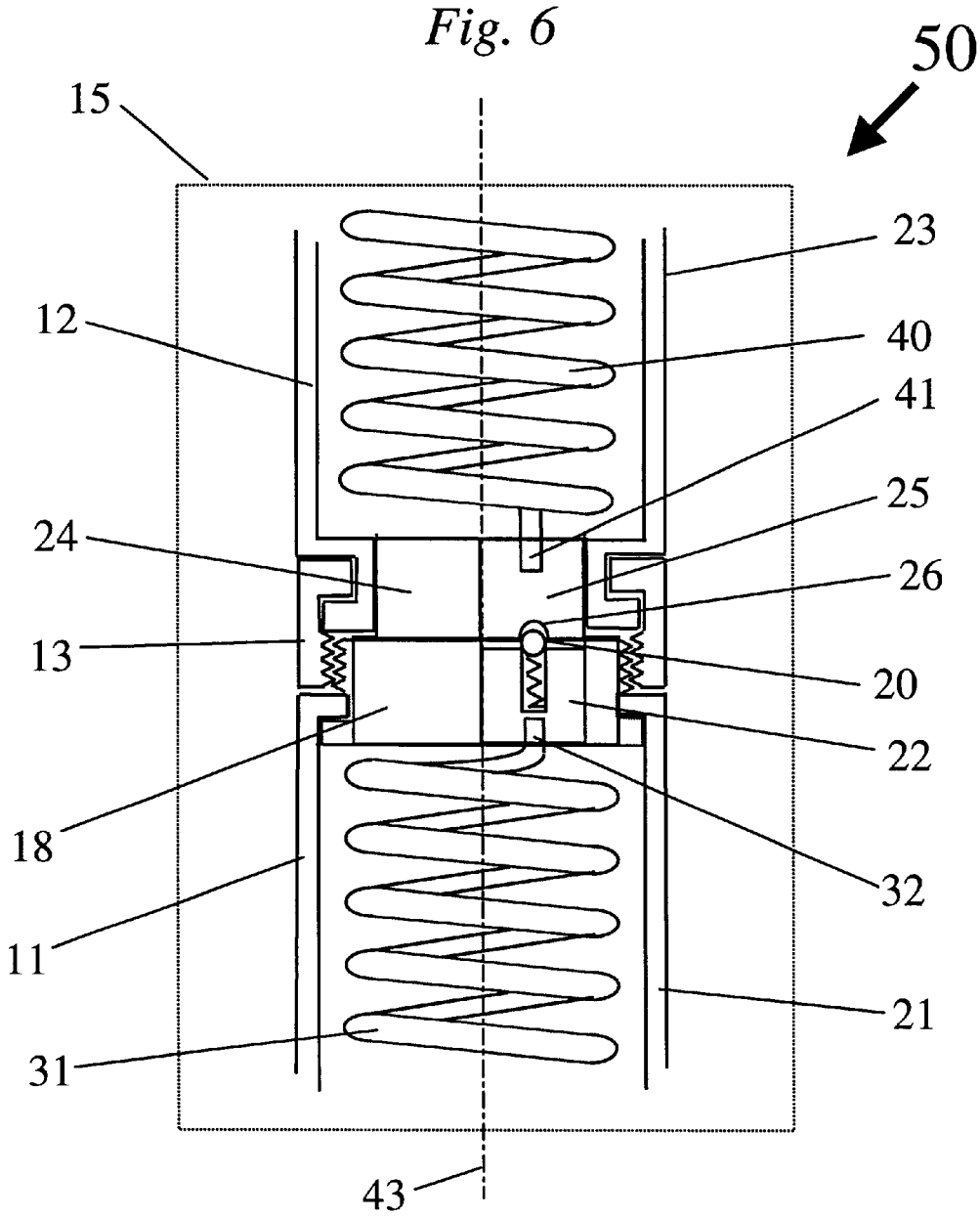
FIG. 6 is a longitudinal cross-section through line A–'A of the switchable antenna of FIG. 1 illustrating a second mode of operation.

Referring now to FIG. 6 which illustrates the longitudinal cross-section of portion 17 in a second mode of operation 50 of antenna 10. In this second mode of operation 50, ball bearing 20 and contact members 18,19 connects respective ends 32,41 of helical antenna 31 and helical antenna 40. When both antenna assemblies 11,12 are rotated to such respective positions as shown, ball bearing 20 and dimple 26 generates a click, as is known in the art for such engagement, to indicate that antenna 10 is ready for this second mode of operation 50. With both antenna assemblies 11,12 in these positions, antenna 10 has increased in length as a result of combining the lengths of both base helical antenna 31 and secondary helical antenna 40. Accordingly, antenna 10 can now transceive different RF signals corresponding to these lengths compared with RF signals corresponding to the length of helical antenna 31 in the first mode of operation 30.

As shown in FIGS. 5 and 6, the switch and adjacent ends 32,41 are intermediately disposed between base end 15 and free end 16. This switch is selectively activated by relative rotation about common longitudinal axis 43 of base antenna assembly 11 and secondary antenna assembly 12.

Advantageously, antenna 10 of the present invention is provided with the switch for selectively electrically coupling adjacent ends 32,41 of helical antenna 31 and helical antenna 40. The relative rotation about common longitudinal axis 43 is possible because secondary antenna assembly 12 is rotatably coupled to base antenna assembly 11 with connector 13. Consequently, this allows antenna 10 to have different lengths corresponding to the wavelengths of different RF signals. Hence, the present invention enables antenna 10 to transceive RF signals varying within a bandwidth for a radio communication device.

A further advantage of the present invention is that secondary antenna assembly 12 is removably mounted to base antenna assembly 11 using connector 13. Accordingly, antenna 10 can be mounted with other secondary antenna assemblies 12 to transceive RF signals not within the above bandwidth. Consequently, with the present invention, antenna 10 can be easily modified to change in length using different secondary antenna assemblies 12 unlike conventional antennas that are constrained to a fixed length.

Although the invention has been described with reference to the above preferred embodiment, it is to be understood that the invention is not restricted to the embodiment described herein.

What is claimed is:

1. A switchable antenna for a radio communication device comprising:

a base antenna assembly comprising a housing with a base antenna;

secondary antenna assembly comprising a housing with a secondary antenna, said secondary antenna assembly being mounted to said base antenna assembly; and a switch for selectively electrically coupling adjacent ends of said base antenna and said secondary antenna, wherein said switch comprises at least one contact ball bearing.

2. A switchable antenna for a radio communication device comprising:

a base antenna assembly comprising a housing with a base antenna;

secondary antenna assembly comprising a housing with a secondary antenna, said secondary antenna assembly being mounted to said base antenna assembly; and a switch for selectively electrically coupling adjacent ends of said base antenna and said secondary antenna, wherein said switch is selectively activated by relative rotation about a common longitudinal axis of said base antenna assembly and said secondary antenna assembly.

3. The switchable antenna as claimed in claim 2 wherein said secondary antenna assembly is removably mounted to said base antenna assembly.

4. A switchable antenna for a radio communication device comprising:

a base antenna assembly comprising a housing with a base antenna;

secondary antenna assembly comprising a housing with a secondary antenna, said secondary antenna assembly being mounted to said base antenna assembly; and a switch for selectively electrically coupling adjacent ends of said base antenna and said secondary antenna, wherein said secondary antenna assembly is rotatably coupled to said base antenna assembly.

5. The switchable antenna as claimed in claim 4 wherein said base antenna is a helical antenna.

6. The switchable antenna as claimed in claim 4 wherein said secondary antenna is a helical antenna.

7. The switchable antenna as claimed in claim 4 wherein said base antenna assembly comprises a mounting member at a base end.

8. The switchable antenna as claimed in claim 7 wherein said secondary antenna assembly comprises a free end distal from said base end, said switch and said adjacent ends being intermediately disposed between said base end and said free end.

* * * * *